US005964133A

United States Patent [19]

Kerr

[11] Patent Number: 5,964,133

[45] Date of Patent: Oct. 12, 1999

[54] METHOD OF PRECISION FINISHING A VACUUM IMAGING DRUM

[75] Inventor: Roger S. Kerr, Brockport, N.Y.

[73] Assignee: Eastman Kodak Company, Rochester, N.Y.

[21] Appl. No.: 08/883,058

[22] Filed: Jun. 26, 1997

[51] Int. Cl.[6] ..... B21K 1/02

[52] U.S. Cl. ..... 82/1.11; 82/101; 346/134

[58] Field of Search ..... 82/1.11, 123, 46, 82/47, 101, 113

[56] References Cited

U.S. PATENT DOCUMENTS

| | | | |
|---|---|---|---|
| 1,851,327 | 3/1932 | Ramsey . | |
| 2,931,692 | 4/1960 | Yontar . | |
| 3,151,554 | 10/1964 | Townsend . | |
| 3,474,457 | 10/1969 | Becker . | |
| 3,835,262 | 9/1974 | Moritz et al. . | |
| 4,074,104 | 2/1978 | Fulkerson . | |
| 4,138,102 | 2/1979 | Palmer . | |
| 4,170,726 | 10/1979 | Okuda . | |
| 4,229,640 | 10/1980 | Longo . | |
| 4,352,973 | 10/1982 | Chase . | |
| 5,268,708 | 12/1993 | Harshbarger et al. . | |
| 5,778,744 | 7/1998 | Braun et al. | 82/1.11 |
| 5,797,186 | 8/1998 | Bode | 29/895.22 |
| 5,829,889 | 11/1998 | Kerr et al. | 384/446 |

*Primary Examiner*—Andrea L. Pitts
*Assistant Examiner*—Mark Williams
*Attorney, Agent, or Firm*—Nelson Adrian Blish; David A. Novais

[57] ABSTRACT

The present invention is for a method of precision finishing a vacuum imaging drum (300) comprising the steps of positioning a finishing tool (352) at an axial starting point; rotating said vacuum imaging drum (300) at a predetermined speed; moving the finishing tool (352) to a radial first position; translating the finishing tool (352) in a first direction, approximately parallel to an axis of rotation (301) of the vacuum imaging drum (300), until at least a portion of a surface of the vacuum imaging drum (300) is transversed; stopping rotation of the vacuum imaging drum (300), wherein a first axial recess (322) is located adjacent the finishing tool (352); returning the finishing tool (352) to the axial starting point; moving the finishing tool (352) to a second radial position (348), wherein the second radial position (348) is closer to the axis of rotation (301) than the first radial position (346); and repeating steps b–g until a predetermined amount of material has been removed from the surface of the vacuum imaging drum (300). In one embodiment, a radial recess (346) is located at the starting point. In another embodiment rotation is stopped at a second radial recess (348). In yet another embodiment, the finishing tool (352) is mounted on a translation stage (220) of a printer (10).

11 Claims, 11 Drawing Sheets

METHOD OF PRECISION FINISHING A VACUUM IMAGING DRUM

FIELD OF THE INVENTION

This invention relates in general to a method of precision finishing a vacuum imaging drum, and more specifically to reducing the spacing variability between a printhead and the vacuum imaging drum in a scanning subsystem for a laser printer.

BACKGROUND OF THE INVENTION

Pre-press color-proofing is a procedure that is used by the printing industry for creating representative images of printed material without the high cost and time that is required to produce printing plates and set up a high-speed, high volume, printing press to produce single proof of an intended image. One such commercially available image processing apparatus, described in commonly assigned U.S. Pat. No. 5,268,708, has half-tone color proofing capabilities. This image processing apparatus forms an intended image on a sheet of thermal print media by transferring dye from a sheet of dye donor material to the thermal print media by thermal energy to the dye donor sheet material. This image processing apparatus is comprised generally of a material supply assembly or carousel, lathe bed scanning subsystem (which includes a lathe bed scanning frame, translation drive, translation stage member, printhead, and vacuum imaging drum), and thermal print media and dye donor sheet material exit transports.

The operation of the image processing apparatus comprises metering a length of the thermal print media (in roll form) from the material assembly carousel. The thermal print media is then measured and cut into sheet form of the required length and transported to the vacuum imaging drum, registered, and wrapped around and secured on the vacuum imaging drum. Next a length of dye donor material (in roll form) is metered from the material supply assembly carousel, measured, and cut into a sheet of the required length. The sheet of donor material is transported to and wrapped around the vacuum imaging drum, superposed in registration with the thermal print media.

After the dye donor sheet material is secured to the periphery of the vacuum imaging drum, the vacuum imaging drum with thermal print media and dye donor sheet material attached, is rotated at a constant speed. A translation drive then traverses the printhead and translation stage member axially along the vacuum imaging drum in coordinated motion with the rotating vacuum imaging drum. These movements combine to produce the intended image on the thermal print media.

After the intended image has been written on the thermal print media, the dye donor sheet material is then removed from the vacuum imaging drum. This is done without disturbing the thermal print media that is beneath it. The dye donor sheet material is then transported out of the image processing apparatus by the dye donor sheet material exit transport. Additional sheets of dye donor sheet material, each sheet a different color, are sequentially superimposed with the thermal print media on the vacuum imaging drum and imaged onto the thermal print media until the intended image is completed. The completed image on the thermal print media is then unloaded from the vacuum imaging drum and transported to an external holding tray on the image processing apparatus by the receiver sheet material exit transport.

The scanning subsystem comprises the mechanism that provides the mechanical actuators for the vacuum imaging drum positioning and motion control to facilitate placement, loading onto, and removal of the thermal print media and the dye donor sheet material from the vacuum imaging drum. The scanning subsystem provides the scanning function by retaining the thermal print media and dye donor sheet material on the rotating vacuum imaging drum. The scanning subsystem generates a once per revolution timing signal to the data path electronics as a clock signal, while the translation drive traverses the translation stage member and printhead axially along the vacuum imaging drum in a coordinated motion, while the vacuum imaging drum rotates past the printhead to allow precise control of the placement of each pixel, in order to produce the intended image on the thermal print media.

The lathe bed scanning frame provides the structure to support the vacuum imaging drum and its rotational drive. The translation drive with the translation stage member and printhead are supported by the two translation bearing rods that are substantially straight along their longitudinal axis and are positioned parallel to the vacuum imaging drum and lead screw. Consequently, they are parallel to each other therein forming a plane with the vacuum imaging drum and lead screw. The translation bearing rods are, in turn, supported by the outside walls of the lathe bed scanning frame of the lathe bed scanning subsystem or write engine. The translation bearing rods are positioned and aligned, permitting low friction movement of the translation stage member and the translation drive. The translation bearing rods are rigid, and prevent sag or distort between the mounting points at their ends. They are arranged parallel with the axis of the vacuum imaging drum. The front translation bearing rod is arranged to locate the axis of the printhead precisely on the axis of the vacuum imaging drum with the axis of the printhead located perpendicular, vertical, and horizontal to the axis of the vacuum imaging drum. The translation stage member, front bearing is arranged to form an inverted "V" and provides only that constraint to the translation stage member. The translation stage member with the printhead mounted on the translation stage member, is held in place by only it's own weight. The rear translation bearing rod locates the translation stage member with respect to rotation of the translation stage member about the axis of the front translation bearing rod. This is done to prevent binding, chatter, or otherwise undesirable vibration or jitter of the translation drive or printhead during the writing process, which would cause an unacceptable artifacts in the intended image. This is accomplished by the rear bearing which engages the rear translation bearing rod only on diametrically opposite side of the translation bearing rod on a line perpendicular to a line connecting the centerlines of the front and rear translation bearing rods.

The translation drive provides relative movement of the printhead by means of a DC servo motor and encoder which rotates a lead screw parallel with the axis of the vacuum imaging drum. The printhead is placed on a translation stage member in "V" shaped grooves, which are formed in the translation stage member, and which are in a precise relationship to the bearings for the front translation stage member supported by the front and rear translation bearing rods. These translation bearing rods are positioned parallel to the vacuum imaging drum, so that it automatically adopts the preferred orientation with respect to the vacuum imaging drum. The printhead is selectively locatable with respect to the translation stage member, and is thus positioned with respect to the vacuum imaging drum surface. By adjusting the distance between the printhead and the vacuum imaging drum surface, as well as angular position of the printhead about it's axis, an accurate means of adjustment for the printhead is provided. An extension spring provides a load against these two adjustment means.

The translation stage member and printhead are attached to a rotatable lead screw (having a threaded shaft) by a drive nut and coupling. The coupling is arranged to accommodate misalignment of the drive nut and lead screw so that only forces parallel to the linear lead screw and rotational forces are imparted to the translation stage member by the lead screw and drive nut. The lead screw rests between two sides of the lathe bed scanning frame of the lathe bed scanning subsystem or write engine, where it is supported by deep groove radial bearings. At the drive end the lead screw continues through the deep groove radial bearing, through a pair of spring retainers, that are separated and loaded by a compression spring to provide axial loading, and to a DC servo drive motor and encoder. The DC servo drive motor induces rotation to the lead screw moving the translation stage member and printhead along the threaded shaft as the lead screw is rotated. The lateral directional movement of the printhead is controlled by switching the direction of rotation of the DC servo drive motor and thus the lead screw.

An autofocus system uses reflected light energy from the thermal print media surface to actively correct for variations in distance between the printhead and the dye donor during the scanning process. An additional light source is used for this focusing application. The light source has a wavelength of approximately 960 nanometers. With this wavelength, the dye layer of the dye donor sheet is essentially transparent and reflected light from the surface of the thermal print media is re-imaged in the plane of a dual cell silicon focus detector arrangement. An analog closed loop servo uses the focus detector error signal to drive an electromagnetic actuator, which moves the last lens element of a lens system to correct for dye layer variability. The servo has both a proportional path and an integral path. In normal operation, the servo drives the focusing system to a near-zero focus error signal. If the position of the last lens element with the closed loop focus error signal at zero, dose not yield a focus position for the maximum transfer of dye to the thermal print media, an offset is applied to the closed loop to operate at a position other than the one that corresponds to the near-zero focus error signal. In this application the circumference of the vacuum imaging drum is larger than the thermal print media and the dye donor along with an axially extending flat that causes the focus system to re-establish the focus position at the beginning of the thermal print media with every revolution of the vacuum imaging drum due to the discontinuation of the tracking surface.

The vacuum imaging drum is cylindrical in shape and includes a hollowed-out interior portion, and further includes a plurality of holes extending through its housing for permitting a vacuum to be applied from the interior of the vacuum imaging drum for supporting and maintaining the position of the thermal print media and dye donor sheet material as the vacuum imaging drum rotates. The ends of the vacuum imaging drum are enclosed by cylindrical plates. The cylindrical end plates are each provided with a centrally disposed spindle which extends outwardly through support bearings and are supported by the lathe bed scanning frame. The drive end spindle extends through the support bearing and is stepped down to receive a DC drive motor armature which is held on by means of a nut. A DC motor stator is stationarily held by the lathe bed scanning frame member, encircling the armature to form a reversible, variable speed DC drive motor for the vacuum imaging drum. An encoder is mounted at the end of the spindle to provide timing signals to the image processing apparatus. The opposite spindle is provided with a central vacuum opening, which is in alignment with a vacuum fitting with an external flange that is rigidly mounted to the lathe bed scanning frame. The vacuum fitting has an extension which extends within but is closely spaced from the vacuum spindle, thus forming a small clearance. With both the thermal print media and dye donor sheet material completely loaded on the vacuum imaging drum the internal vacuum level of the vacuum imaging drum is approximately 50–60 inches of water in this configuration.

The outer surface of the vacuum imaging drum is provided with an axially extending flat, which extends over approximately eight degrees of the vacuum imaging drum circumference. The vacuum imaging drum is also provided with a circumferential recess which extends circumferentially from one side of the axially extending flat circumferentially around the vacuum imaging drum to the other side of the axially extending flat, and from approximately one inch from one end of the vacuum imaging drum, to approximately one inch from the other end of the vacuum imaging drum. The thermal print media when mounted on the vacuum imaging drum is seated in the circumferential recess and therefor the circumferential recess has a depth substantially equal to the thermal print media thickness seated there within which is approximately 0.004 inches in thickness. The purpose of the circumferential recess on the vacuum imaging drum surface is to eliminate any creases in the sheets of the dye donor sheet material, as they are drawn over the thermal print media during the loading of the dye donor sheet materials. This assures that no folds or creases will be generated in the dye donor sheet materials which could extend into the image area and seriously adversely affect the intended image. The circumferential recess also substantially eliminates the entrapment of air along the edge of the thermal print media, where it is difficult for the vacuum holes in the vacuum imaging drum surface to assure the removal of the entrapped air. Any residual air between the thermal print media and the dye donor sheet material, can also adversely affect the intended image.

The purpose of the extending flat is two-fold. First, it assures that the leading and trailing ends of the dye donor sheet material are protected from the effect of the air during the relatively high speed rotation that the vacuum imaging drum undergoes during the imaging process. Thus the air will have less tendency to lift the leading or trailing edges of the dye donor sheet material. The vacuum imaging drum axially extending flat also ensures that the leading and trailing ends of the dye donor sheet material are recessed from the vacuum imaging drum periphery. This reduces the chance that the dye donor sheet material can not come in contact with other parts of the image processing apparatus, such as the printhead, causing a jam and possible loss of the intended image or worse, catastrophic damage to the image processing apparatus.

The vacuum imaging drum axially extending flat also acts to impart a bending force to the ends of the dye donor sheet materials when they are held onto the vacuum imaging drum surface by vacuum from within the interior of the vacuum imaging drum. Consequently when the vacuum is turned off to that portion of the vacuum imaging drum, the end of the dye donor sheet material will tend to lift from the surface of the vacuum imaging drum. Thus turning off the vacuum eliminates the bending force on the dye donor sheet material, and is used as an advantage in the removal of the dye donor sheet material from the vacuum imaging drum.

Although the image processing apparatus described above is satisfactory, it is not without room for improvement.

Image quality specifications for existing image processing apparatus requires scanning subsystem tolerance in the 10 micron range. This tolerance is directly related to variations in the distance between the printhead and the dye donor material, which in turn, is related to the surface variations of the vacuum imaging drum, and movement of the linear translation system. To correct for this variability, a focusing system is required, adding mechanical complexity and increasing cost. It is desirable to minimize these variations which would result in improvement of the image quality and eliminate the need for a focusing system, reducing the mechanical complexity and decreasing the cost of the image processing apparatus.

Prior art systems of finishing the surface of a drum move a cutting or grinding tool into contact with the surface of the rotating drum and translate the tool in an axial direction from a first end of the drum to a second end of the drum. When the cutting tool reaches the second end of the drum, it is retracted, translated axially to the starting position, and again moved into contact with the surface of the drum at a position closer to the axis of rotation of the drum. This method of finishing the surface of the drum, however, has some drawbacks in that the pressure of the tool against the surface of the rotating drum builds mechanical stress into the finishing tool, making it difficult to position the cutting tool the correct incremental distance closer to the axis of rotation similar to a historesis effect. Also, rotating drums are conventionally finished and then assembled into a completed apparatus, such as an image processing apparatus. Thus, regardless of the degree of surface finish, other variations in the completed apparatus, such as wear of the bearings, variations in lead screw tolerances, and translation movements of the printhead, add additional cumulative errors.

SUMMARY OF THE INVENTION

It is an object of the present invention to decrease variations in distance between the vacuum imaging drum and printhead of an image processing apparatus.

It is also an object of the present invention to decrease variations in distance between the vacuum imaging drum and the linear translation system of an imaging processing apparatus.

The present invention is directed to overcoming one or more of the problems set forth above. According to one aspect of the invention, a vacuum imaging drum is precision finished by:

a) positioning a finishing tool at an axial starting point;

b) rotating the vacuum imaging drum at a predetermined speed;

c) moving the finishing tool to a radial first position;

d) translating the finishing tool in a first direction, approximately parallel to an axis of rotation of the vacuum imaging drum, until at least a portion of a surface of the vacuum imaging drum is transversed;

e) stopping rotation of the vacuum imaging drum, wherein a first axial recess is located adjacent the finishing tool;

f) returning the finishing tool to the axial starting point;

g) moving the finishing tool to a second radial position, wherein the second radial position is closer to the axis of rotation than the first radial position; and h) repeating steps b–g until a predetermined amount of material has been removed from the surface of the vacuum imaging drum.

In one embodiment, a radial recess is located at the starting point. In another embodiment, rotation is stopped at a second radial recess. In yet another embodiment, the finishing tool is mounted on a translation stage of a printer.

An image processing apparatus according to the present invention improves the image quality and increases useable depth of focus for an image processing laser array to reduced variation in the surface of the vacuum imaging drum. This improvement in the dimensional tolerance allows the use of a fixed focus printhead with a once per page focus, and may eliminate the need for an auto-focusing system.

DETAILED DESCRIPTION OF THE INVENTION

Figure 1:
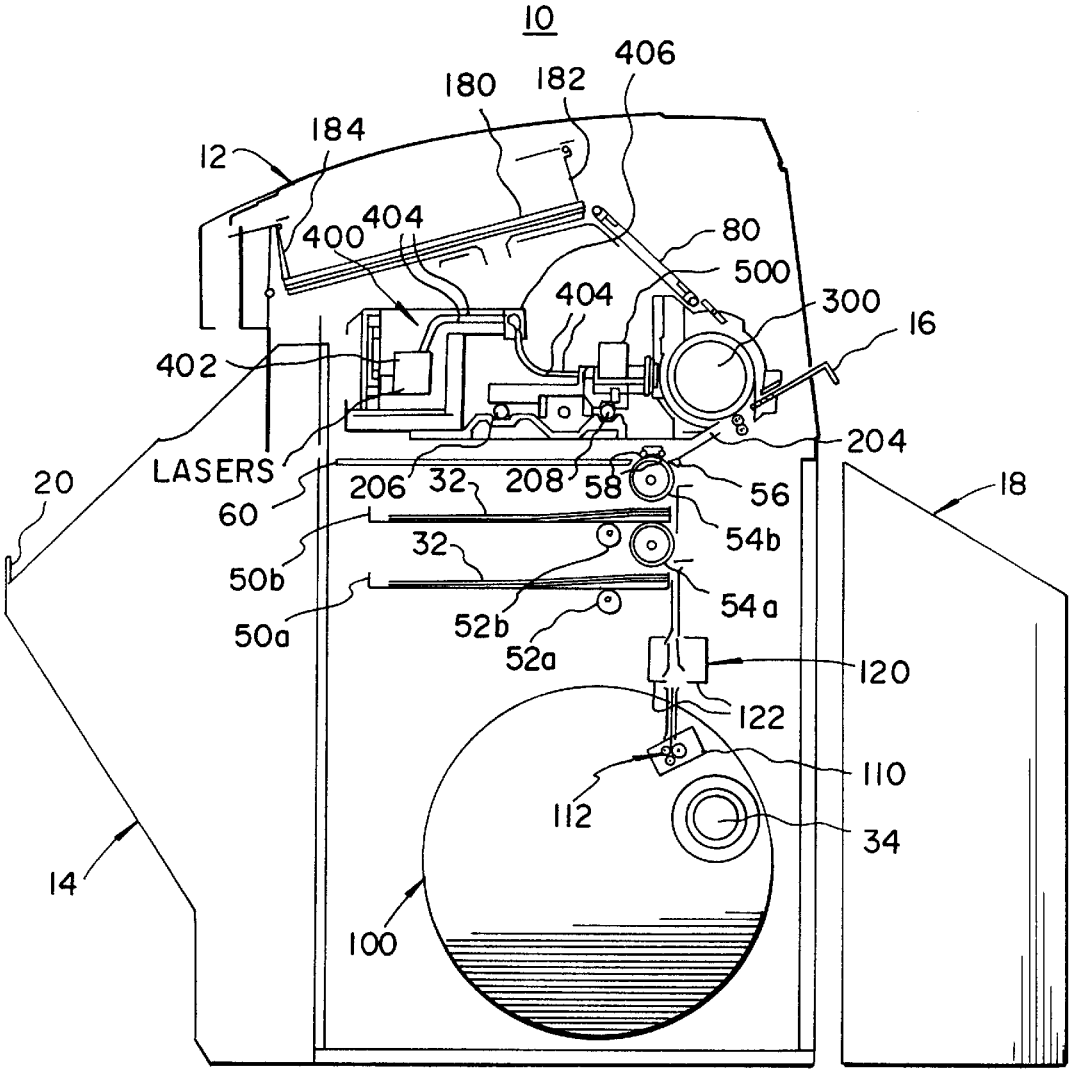
FIG. 1 is a side view in vertical cross section of an image processing apparatus according to the present invention.

Referring to FIG. 1, there is illustrated an image processing apparatus 10 according to the present invention having an image processor housing 12 which provides a protective cover. A movable, hinged image processor door 14 is attached to the front portion of the image processor housing 12 permitting access to the two sheet material trays, lower sheet material tray 50*a* and upper sheet material tray 50*b*, that are positioned in the interior portion of the image processor housing 12 for supporting thermal print media 32, thereon. Only one of the sheet material trays 50 dispenses the thermal print media 32 out of its sheet material tray 50 to create an intended image thereon; the alternate sheet material tray either holds an alternative type of thermal print media 32 or functions as a back up sheet material tray. Lower sheet material tray 50*a* includes a lower media lift cam 52*a* for lifting the lower sheet material tray 50*a* and ultimately the thermal print media 32, upwardly toward a rotatable, lower media roller 54*a* and toward a second rotatable, upper media roller 54*b* which, when both are rotated, permits the thermal print media 32 to be pulled upwardly towards a media guide 56. The upper sheet material tray 50*b* includes a upper media lift cam 52*b* for lifting the upper sheet material tray 50*b* and ultimately the thermal print media 32 towards the upper media roller 54*b* which directs it towards the media guide 56.

The movable media guide 56 directs the thermal print media 32 under a pair of media guide rollers 58 which engages the thermal print media 32 for assisting the upper media roller 54*b* in directing thermal print media onto the media staging tray 60. The media guide 56 is attached and hinged to the lathe bed scanning frame 202 at one end, and is uninhibited at its other end for permitting multiple positioning of the media guide 56. The media guide 56 then rotates its uninhibited end downwardly, as illustrated in the position shown, and the direction of rotation of the upper media roller 54*b* is reversed for moving the thermal print medium receiver sheet material 32 resting on the media staging tray 60 under the pair of media guide rollers 58, upwardly through an entrance passageway 204 and around a rotatable vacuum imaging drum 300.

A roll 30 of dye donor material 34 is connected to the media carousel 100 in a lower portion of the image processor housing 12. Four rolls 30 are used, but only one is shown for clarity. Each roll 30 includes a dye donor material 34 of a different color, typically black, yellow, magenta and cyan. These dye donor materials 34 are ultimately cut into dye donor sheet materials 36 and passed to the vacuum imaging drum 300 for forming the medium from which dyes imbedded therein are passed to the thermal print media 32 resting thereon, which process is described in detail herein below. In this regard, a media drive mechanism 110 is attached to each roll of dye donor material 34, and includes three media drive rollers 112 through which the dye donor material 34 of interest is metered upwardly into a media knife assembly 120. After the dye donor material 34 reaches a predetermined position, the media drive rollers 112 cease driving the dye donor material 34 and the two media knife blades 122 positioned at the bottom portion of the media knife assembly 120 cut the dye donor material 34 into dye donor sheet materials 36. The lower media roller 54*b* and the upper media roller 54*b* along with the media guide 56 then pass the dye donor sheet material 36 onto the media staging tray 60 and ultimately to the vacuum imaging drum 300 and in registration with the thermal print media 32 using the same process as described above for passing the thermal print media 32 onto the vacuum imaging drum 300. The dye donor sheet material 36 now rests atop the thermal print media 32 with a narrow gap between the two created by microbeads imbedded in the surface of the thermal print media 32.

A laser diode assembly 400 includes a quantity of laser diodes 402 in its interior, the laser diodes 402 are connected via fiber optic cables 404 to a distribution block 406 and ultimately to the printhead 500. The printhead 500 directs thermal energy received from the laser diodes 402 causing the dye donor sheet material 36 to pass the desired color across the gap to the thermal print media 32. The printhead 500 is attached to a lead screw 250 via the lead screw drive nut 254 and drive coupling 256 (not shown in FIG. 1) for permitting movement axially along the longitudinal axis of the vacuum imaging drum 300 for transferring the data to create the intended image onto the thermal print media 32.

For writing, the vacuum imaging drum 300 rotates at a constant velocity, and the printhead 500 begins at one end of the thermal print media 32 and traverse the entire length of the thermal print media 32 for completing the transfer process for the particular dye donor sheet material 36 resting on the thermal print media 32. After the printhead 500 has completed the transfer process, for the particular dye donor sheet material 36 resting on the thermal print media 32 the dye donor sheet material 36 is then removed from the vacuum imaging drum 300 and transferred out the image processor housing 12 via a skive or ejection chute 16. The dye donor sheet material 36 eventually comes to rest in a donor waste bin 18 for removal by the user. The above described process is then repeated for the other three rolls of dye donor materials 34.

After the color from all four sheets of the dye donor sheet materials 36 have been transferred and the dye donor sheet materials 36 have been removed from the vacuum imaging drum 300, the thermal print media 32 is removed from the vacuum imaging drum 300 and transported via a transport mechanism 80 to a color binding assembly 180. The media entrance door 182 of the color binding assembly 180 is opened to permit the thermal print media 32 to enter the color binding assembly 180, and shuts once the thermal print media 32 comes to rest in the color binding assembly 180. The color binding assembly 180 processes the thermal print media 32 for further binding the transferred colors on the thermal print media 32 and for sealing the microbeads thereon. After the color binding process has been completed, the media exit door 184 is opened and the thermal print media 32 with the intended image thereon passes out of the color binding assembly 180 and the image processor housing 12 and comes to rest against a media stop 20.

Figure 2:
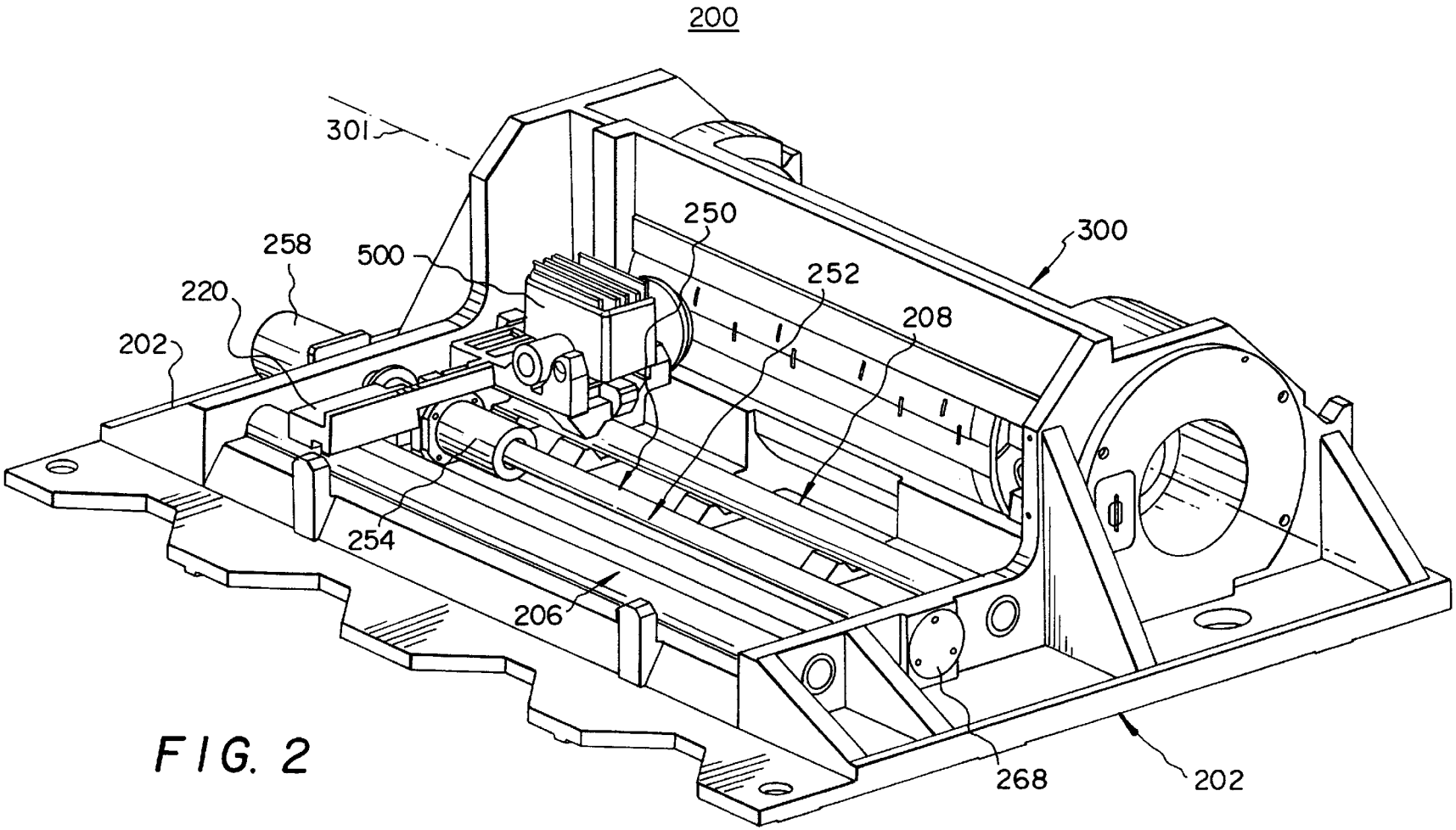
FIG. 2 is a perspective view of the scanning subsystem of the present invention.

Referring to FIG. 2, there is illustrated a perspective view of the lathe bed scanning subsystem 200 of the image processing apparatus 10, including the vacuum imaging drum 300, printhead 500, and lead screw 250 assembled in the lathe bed scanning frame 202. The vacuum imaging drum 300 is mounted for rotation about an axis of rotation 301 in the lathe bed scanning frame 202. The printhead 500 is movable with respect to the vacuum imaging drum 300, and is arranged to direct a beam of light to the dye donor sheet material 36. The beam of light from the printhead 500 for each laser diode 402 (not shown in FIG. 2) is modulated individually by modulated electronic signals from the image processing apparatus 10, which are representative of the shape and color of the original image, so that the color on the dye donor sheet material 36 is heated to cause volatilization only in those areas in which its presence is required on the thermal print media 32 to reconstruct the shape and color of the original image.

The printhead 500 is mounted on a movable translation stage member 220 which, in turn, is supported for low friction slidable movement on translation bearing rods 206 and 208. The translation bearing rods 206 and 208 are sufficiently rigid so that they do not sag or distort between their mounting points and are arranged as parallel as possible with the axis 301 of the vacuum imaging drum 300 with the axis of the printhead 500 perpendicular to the axis 301 of the vacuum imaging drum 300 axis. The front translation bearing rod 208 locates the translation stage member 220 in the vertical and the horizontal directions with respect to axis 301 of the vacuum imaging drum 300. The rear translation bearing rod 206 locates the translation stage member 220 only with respect to rotation of the translation stage member 220 about the front translation bearing rod 208 so that there is no over-constraint condition of the translation stage member 220 which might cause it to bind, chatter, or otherwise impart undesirable vibration or jitters to the printhead 500 during the generation of an intended image.

Figure 3:
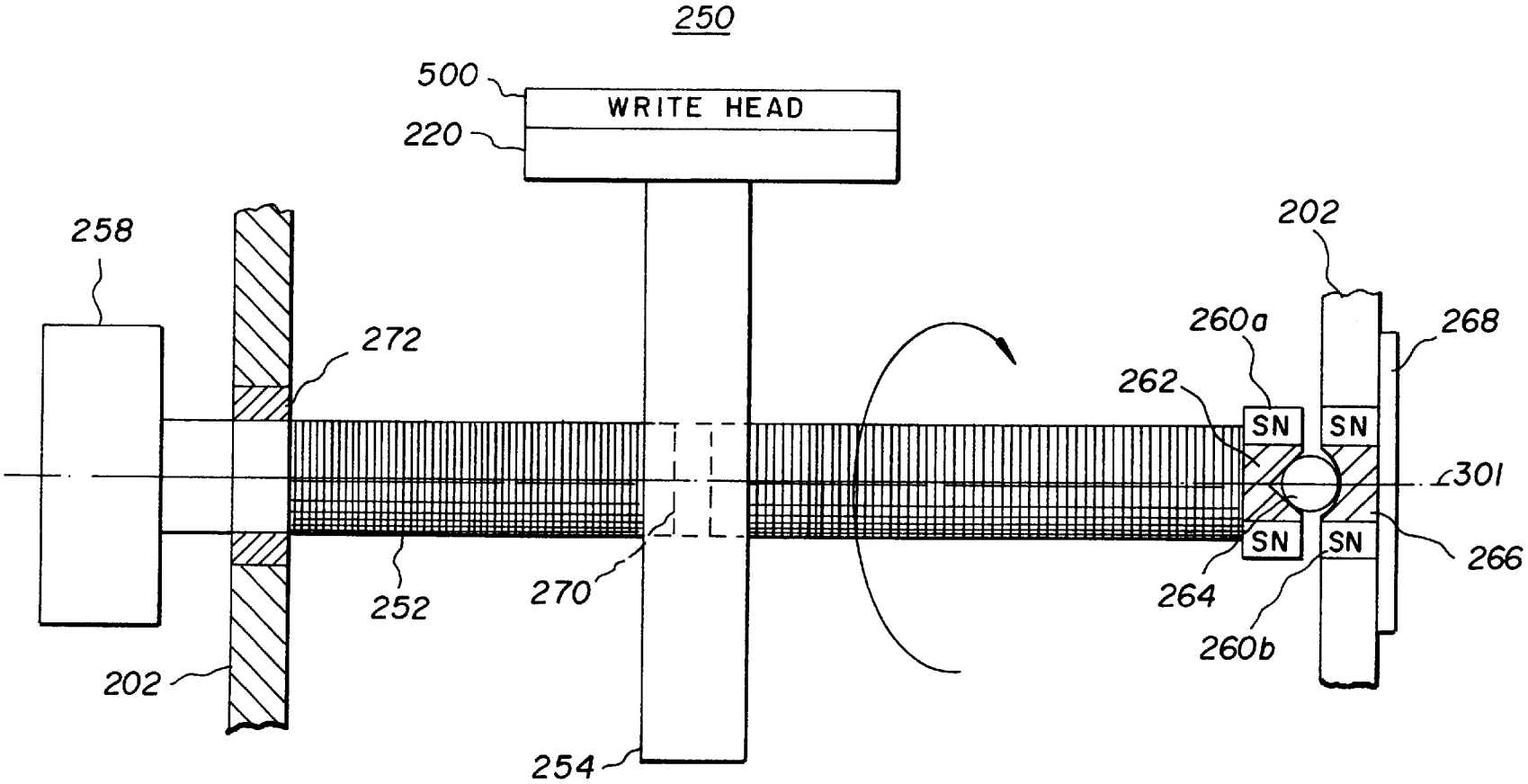
FIG. 3 is a top view in horizontal cross section, partially in phantom, of the lead screw of the present invention.

Referring to FIGS. 2 and 3, a lead screw 250 is shown which includes an elongated, threaded shaft 252 which is attached to the linear drive motor 258 on its drive end and to the lathe bed scanning frame 202 by means of a radial bearing 272. A lead screw drive nut 254 includes grooves in its hollowed-out center portion 270 for mating with the threads of the threaded shaft 252 for permitting the lead screw drive nut 254 to move axially along the threaded shaft 252 as the threaded shaft 252 is rotated by the linear drive motor 258. The lead screw drive nut 254 is integrally attached to the to the printhead 500 through the lead screw coupling 256 (not shown) and the translation stage member 220 at its periphery so that as the threaded shaft 252 is rotated by the linear drive motor 258 the lead screw drive nut 254 moves axially along the threaded shaft 252 which in turn moves the translation stage member 220 and ultimately the printhead 500 axially along the vacuum imaging drum 300.

As best illustrated in FIG. 3, an annular-shaped axial load magnet 260*a* is integrally attached to the driven end of the threaded shaft 252, and is in a spaced apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262 part of the threaded shaft 252 rests in the hollowed-out portion of the annular-shaped axial load magnet 260*a*, and includes a generally V-shaped surface at the end for receiving a ball bearing 264. A circular-shaped insert 266 is placed in the hollowed-out portion of the other annular-shaped axial load magnet 260*b*, and includes an accurate-shaped surface on one end for receiving the ball bearing 264, and a flat surface at its other end for receiving an end cap 268 placed over the annular-shaped axial load magnet 260*b* and attached to the lathe bed scanning frame 202 for protectively covering the annular-shaped axial load magnet 260*b* and providing an axial stop for the lead screw 250. The circular shaped insert 266 is preferably made of material such as Rulon J or Delrin AF, both well known in the art.

The lead screw 250 operates as follows. The linear drive motor 258 is energized and imparts rotation to the lead screw 250, as indicated by the arrows, causing the lead screw drive nut 254 to move axially along the threaded shaft 252. The annular-shaped axial load magnets 260*a* and 260*b* are magnetically attracted to each other which prevents axial movement of the lead screw 250. The ball bearing 264, however, permits rotation of the lead screw 250 while maintaining the positional relationship of the annular-shaped axial load magnets 260, i.e., slightly spaced apart, which prevents mechanical friction between them while obviously permitting the threaded shaft 252 to rotate.

The printhead 500 travels in a path along the vacuum imaging drum 300, while being moved at a speed synchronous with the vacuum imaging drum 300 rotation and proportional to the width of the writing swath 450, not shown. The pattern that the printhead 500 transfers to the thermal print media 32 along the vacuum imaging drum 300, is a helix.

Figure 4:
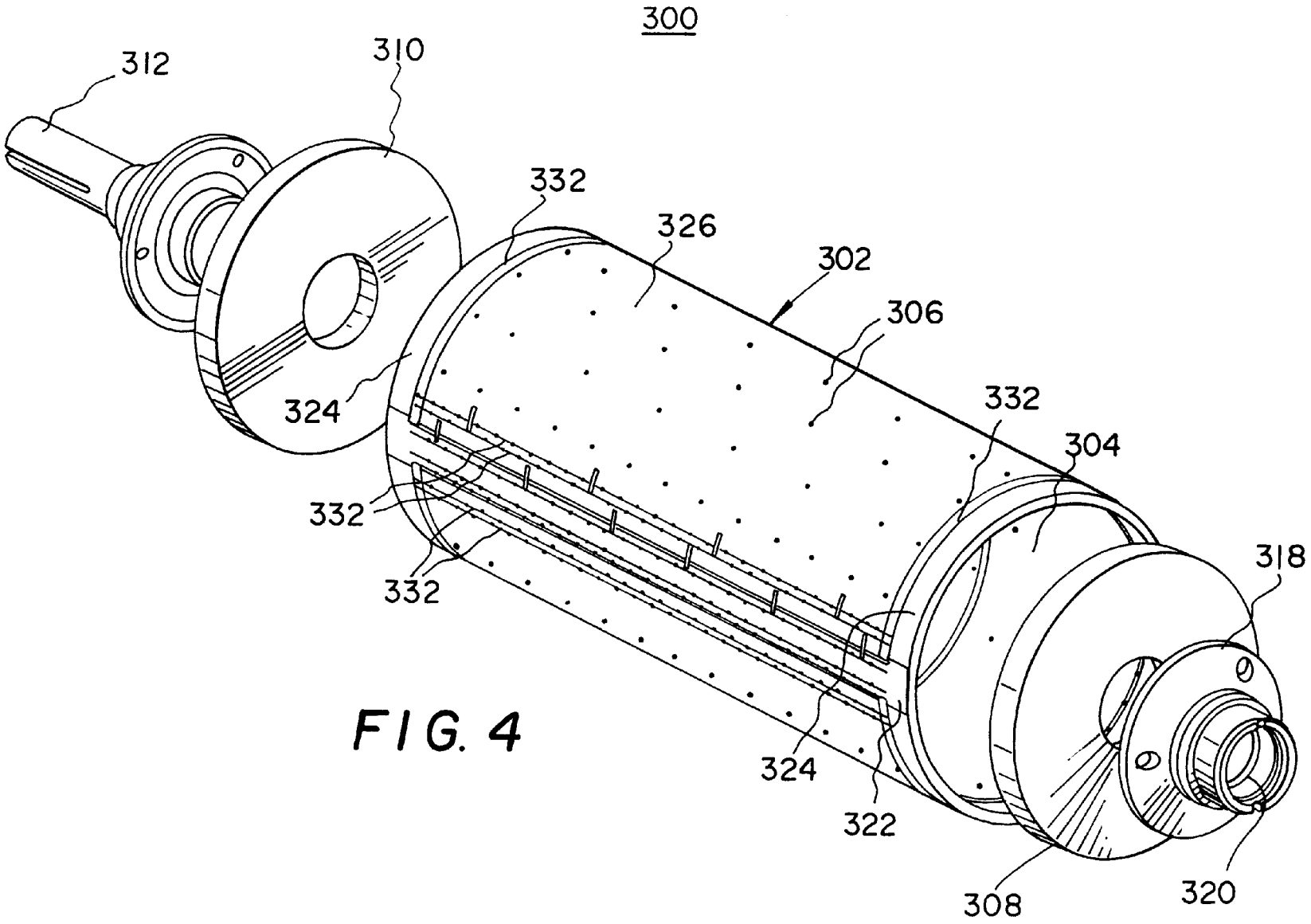
FIG. 4 is an exploded, perspective view of the vacuum imaging drum of the present invention.

Referring to FIG. 4, there is illustrated an exploded view of the vacuum imaging drum 300. The vacuum imaging drum 300 has a cylindrical shaped vacuum drum housing 302 that has a hollowed-out interior portion 304, and further includes a plurality of vacuum grooves 332 and vacuum holes 306 which extend through the vacuum drum housing 302 for permitting a vacuum to be applied from the hollowed-out interior portion 304 of the vacuum imaging drum 300 for supporting and maintaining position of the thermal print media 32, and the dye donor sheet material 36, as the vacuum imaging drum 300 rotates.

The ends of the vacuum imaging drum 300 are closed by the vacuum end plate 308, and the drive end plate 310. The drive end plate 310, is provided with a centrally disposed drive spindle 312 which extends outwardly therefrom through a support bearing 314 (not shown), the vacuum end plate 308 is provided with a centrally disposed vacuum spindle 318 which extends outwardly therefrom through another support bearing 314 (not shown).

The drive spindle 312 extends through the support bearing 314 (not shown) and is stepped down to receive a DC drive motor armature 316 (not shown), which is held on by means of a drive nut 340 (not shown). A DC motor stator 342 (not shown) is stationary held by the late bed scanning frame member 202, encircling the DC drive motor armature 316 to form a reversible, variable DC drive motor for the vacuum imaging drum 300. At the end of the drive spindle 312 a drum encoder 344 is mounted to provide the timing signals to the image processing apparatus 10.

The vacuum spindle 318 is provided with a central vacuum opening 320 which is in alignment with a vacuum fitting 222 (not shown) with an external flange that is rigidly mounted to the lathe bed scanning frame 202. The vacuum fitting 222 (not shown) has an extension which extends within but is closely spaced from the vacuum spindle 318, thus forming a small clearance. With this configuration, a slight vacuum leak is provided between the outer diameter of the vacuum fitting 222 (not shown) and the inner diameter of the central vacuum opening 320 of the vacuum spindle 318. This assures that no contact exists between the vacuum fitting 222 (not shown) and the vacuum imaging drum 300 which might impart uneven movement or jitters to the vacuum imaging drum 300 during its rotation.

The opposite end of the vacuum fitting 222 (not shown) is connected to a high-volume vacuum blower 224 (not shown) which is capable of producing 50–60 inches of water at an air flow volume of 60–70 cfm. And provides the vacuum to the vacuum imaging drum 300 supporting the various internal vacuum levels of the vacuum imaging drum 300 required during the loading, scanning and unloading of the thermal print media 32 and the dye donor sheet materials 36 to create the intended image. With no media loaded on the vacuum imaging drum 300 the internal vacuum level of the vacuum imaging drum 300 is approximately 10–15 inches of water. With just the thermal print media 32 loaded on the vacuum imaging drum 300 the internal vacuum level of the vacuum imaging drum 300 is approximately 20–25 inches of water this level is required such that when a dye donor sheet material 36 is removed. The thermal print media 32 must not move otherwise color to color registration could not be maintained. With both the thermal print media 32 and dye donor sheet material 36 completely loaded on the vacuum imaging drum 300 the internal vacuum level of the vacuum imaging drum 300 is approximately 50–60 inches of water in this configuration.

Figure 5:
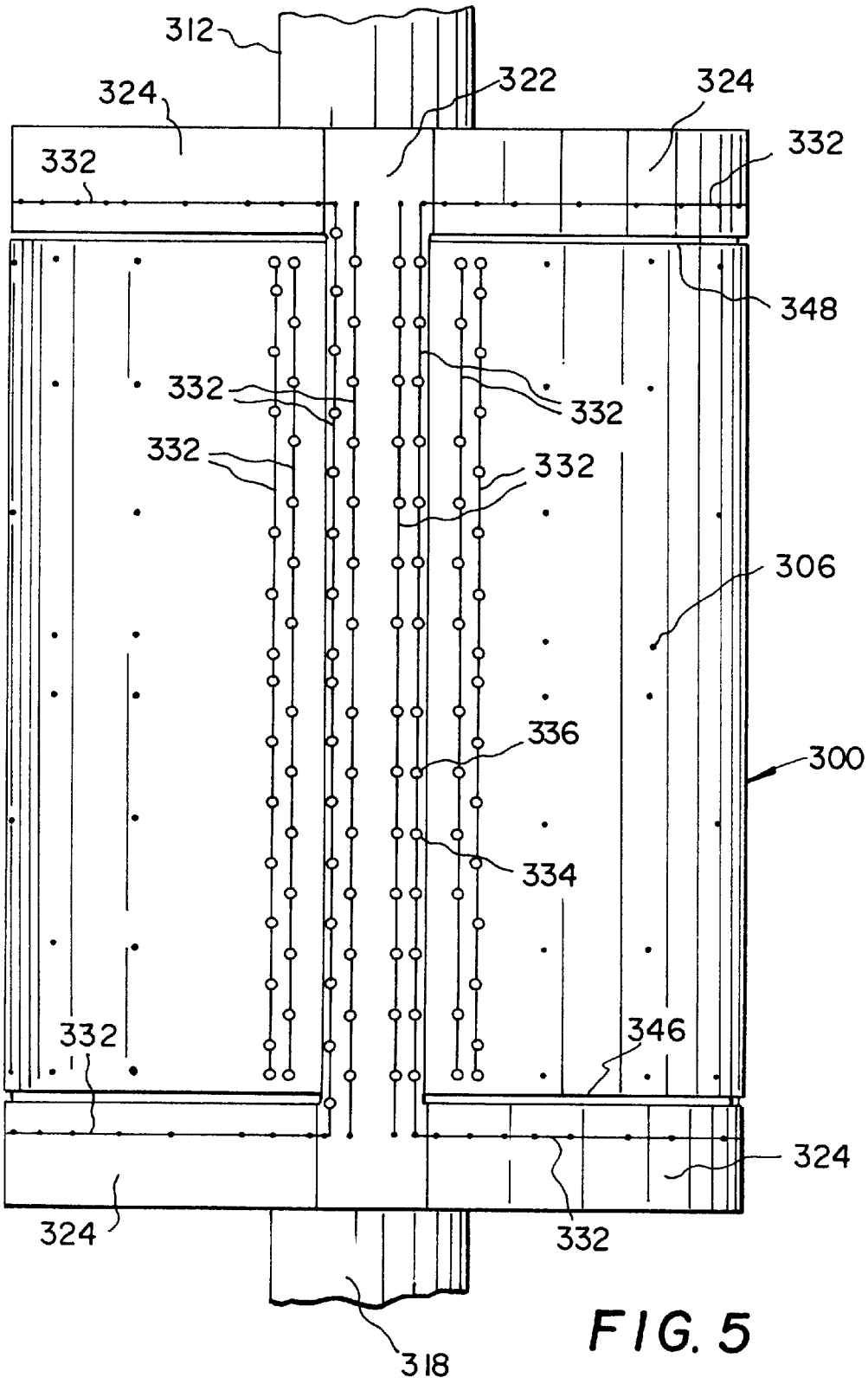
FIG. 5 is a plane view of the vacuum imaging drum surface of the present invention.

The outer surface of the vacuum imaging drum 300 is provided with an axially extending flat 322, shown FIG. 5, which extends approximately eight degrees around the vacuum imaging drum's 300 circumference. The vacuum imaging drum 300 is also provided with donor support rings 324 which form a circumferential recess 326 which extends circumferentially from one side of the axially extending flat 322 around the vacuum imaging drum 300 to the other side of the axially extending flat 322, and from approximately one inch from one end of the vacuum imaging drum 300 to approximately one inch from the other end of the vacuum imaging drum 300.

Figure 6A:
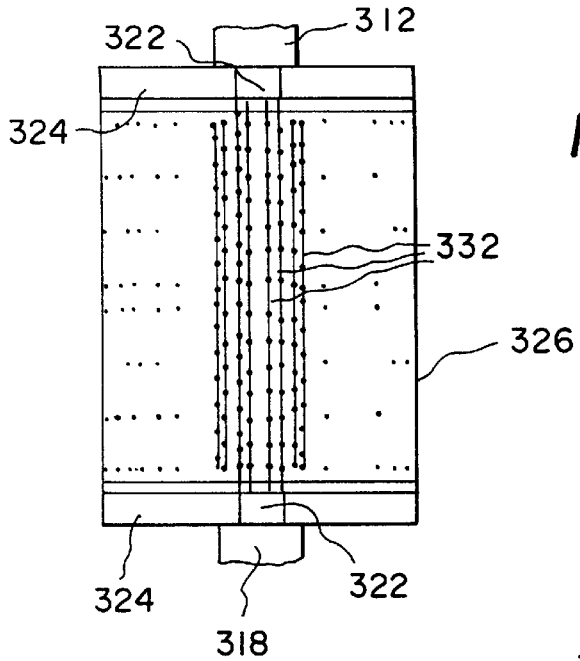
FIGS. 6*a*–6*c* is a plane view of the vacuum imaging drum showing the sequence of placement for the thermal print media and dye donor sheet material.
Figure 6B:
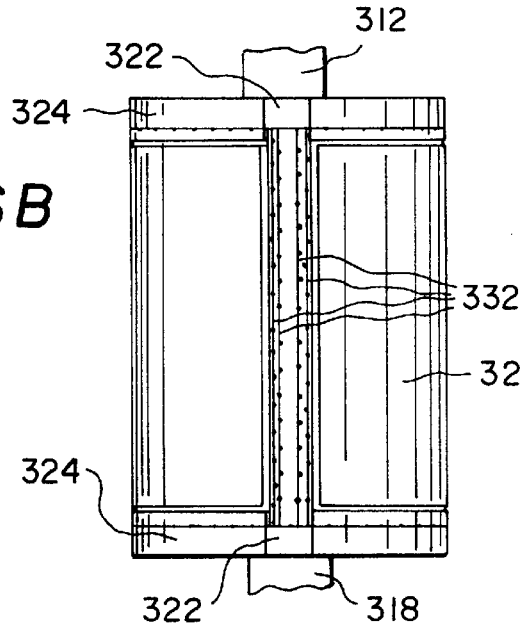
Figure 6C:
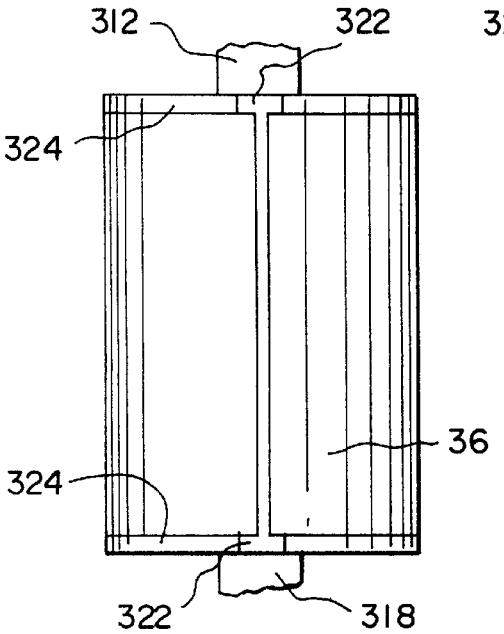

The thermal print media 32 when mounted on the vacuum imaging drum is seated within the circumferential recess 326, as shown FIG. 6*a* through 6*c*. The donor support rings 324 have a thickness substantially equal to the thermal print media 32 thickness, approximately 0.004 inches in thickness. The purpose of the circumferential recess 326 on the vacuum imaging drum 300 surface is to eliminate any creases in the dye donor sheet material 36, as it is drawn down over the thermal print media 32 during the loading of the dye donor sheet material 36. This ensures that no folds or creases will be generated in the dye donor sheet material 36 which could extend into the image area and seriously adversely affect the intended image. The circumferential recess 326 also substantially eliminates the entrapment of air along the edge of the thermal print media 32, where it is difficult for the vacuum holes 306 in the vacuum imaging drum 300 surface to assure the removal of the entrapped air. Any residual air between the thermal print media 32 and the dye donor sheet material 36, can also adversely affect the intended image.

The axially extending flat 322 assures that the leading and trailing ends of the dye donor sheet material 36 are some what protected from the effect of increased air turbulence during the relatively high speed rotation that the vacuum imaging drum 300 undergoes during the image scanning process. Thus increased air turbulence will have less tendency to lift or separate the leading or trailing edges of the dye donor sheet material 36 off from the vacuum imaging drum 300, also the axially extending flat 322 ensures that the leading and trailing ends of the dye donor sheet material 36 are recessed from the vacuum imaging drum 300 periphery. This reduces the chance that the dye donor sheet material 36 can come in contact with other parts of the image processing apparatus 10, such as the printhead 500, this could cause a media jam within the image processing apparatus, resulting in the possible loss of the intended image or at worse catastrophic damage to the image processing apparatus 10 possibly damaging the printhead 500.

Figure 7:
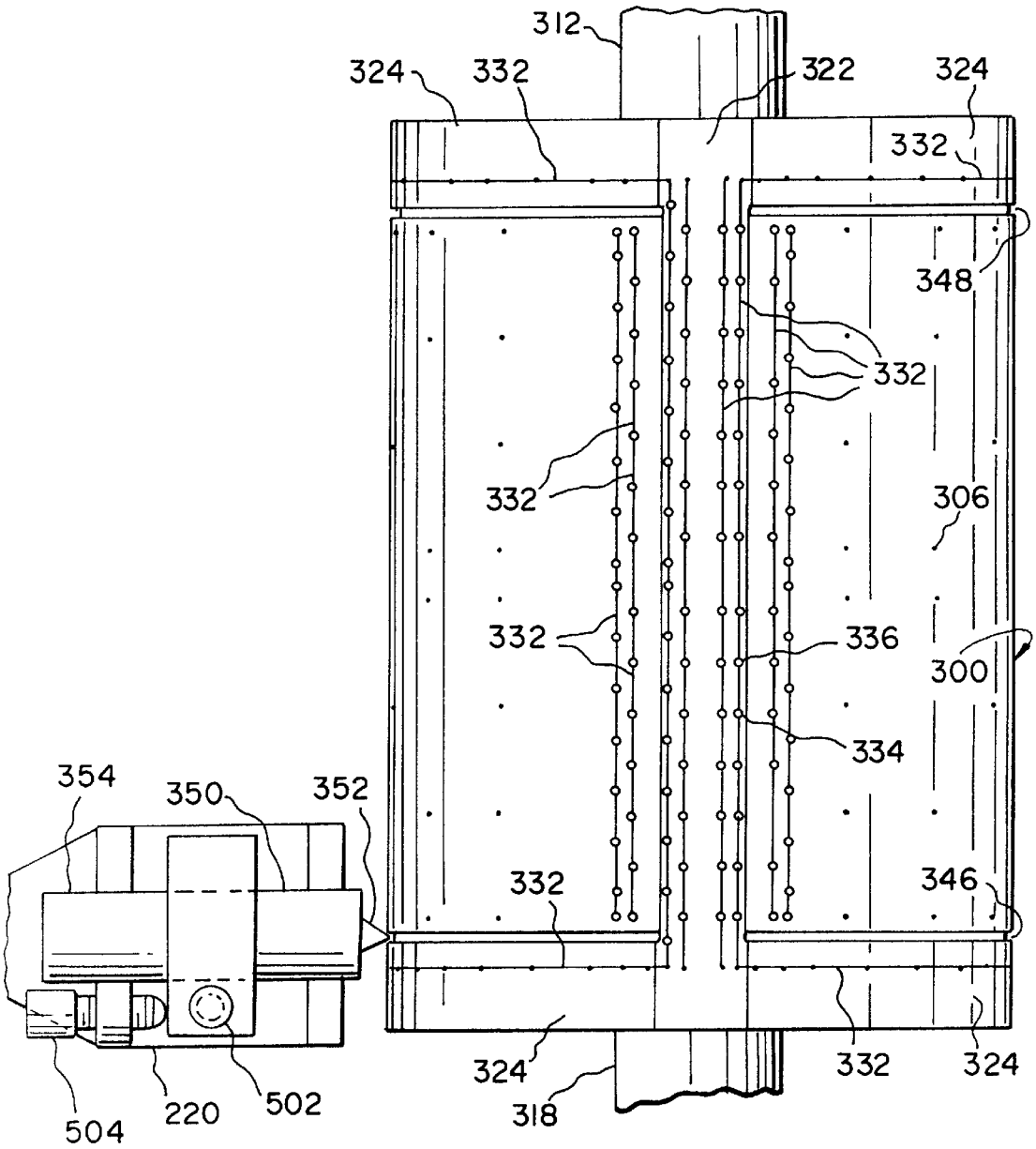
FIG. 7 is a plane view of the vacuum imaging drum with the finishing assembly positioned in the first relief.
Figure 8:
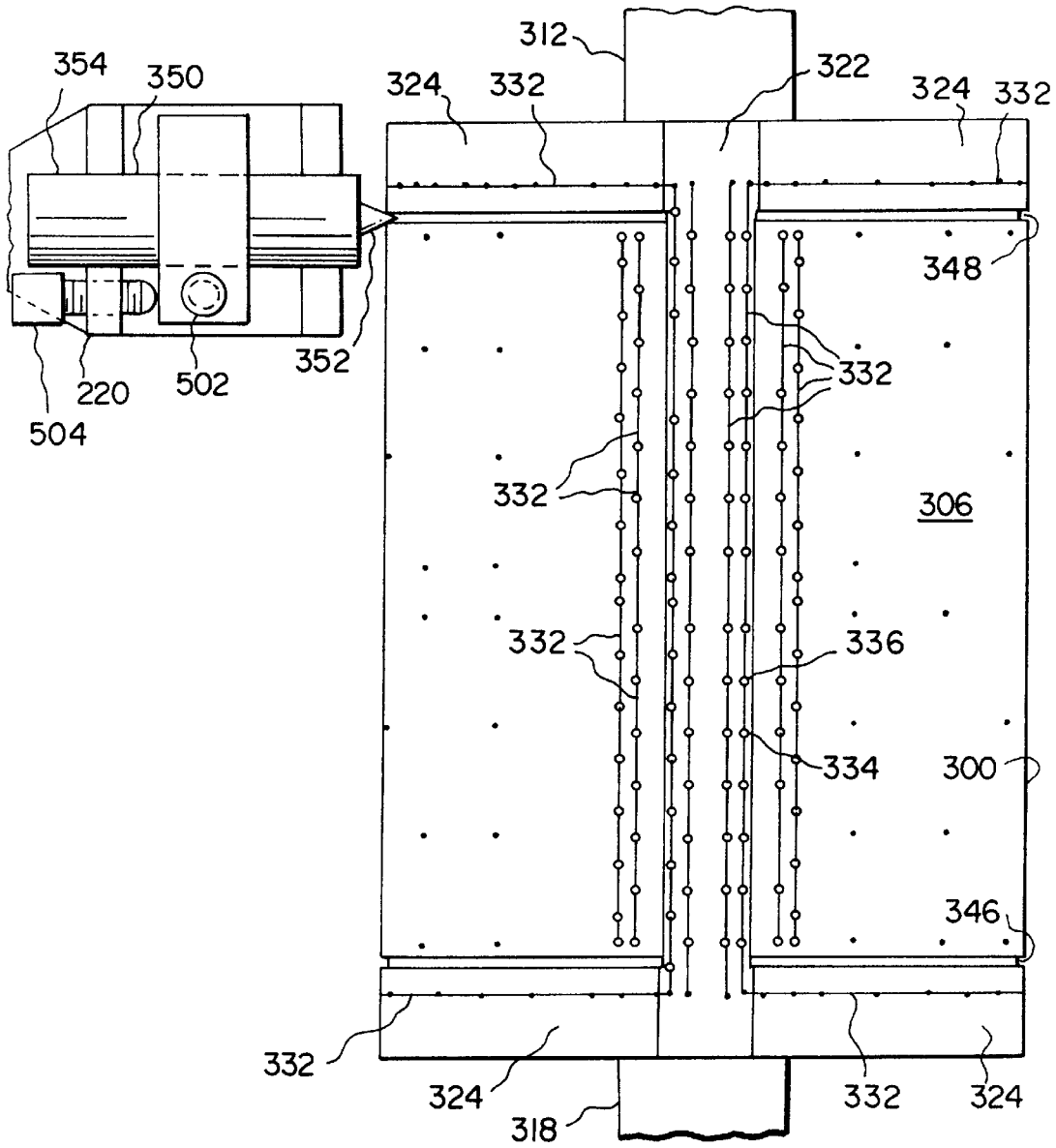
FIG. 8 is a plane view of the vacuum imaging drum with the finishing assembly positioned in the second relief.
Figure 9:
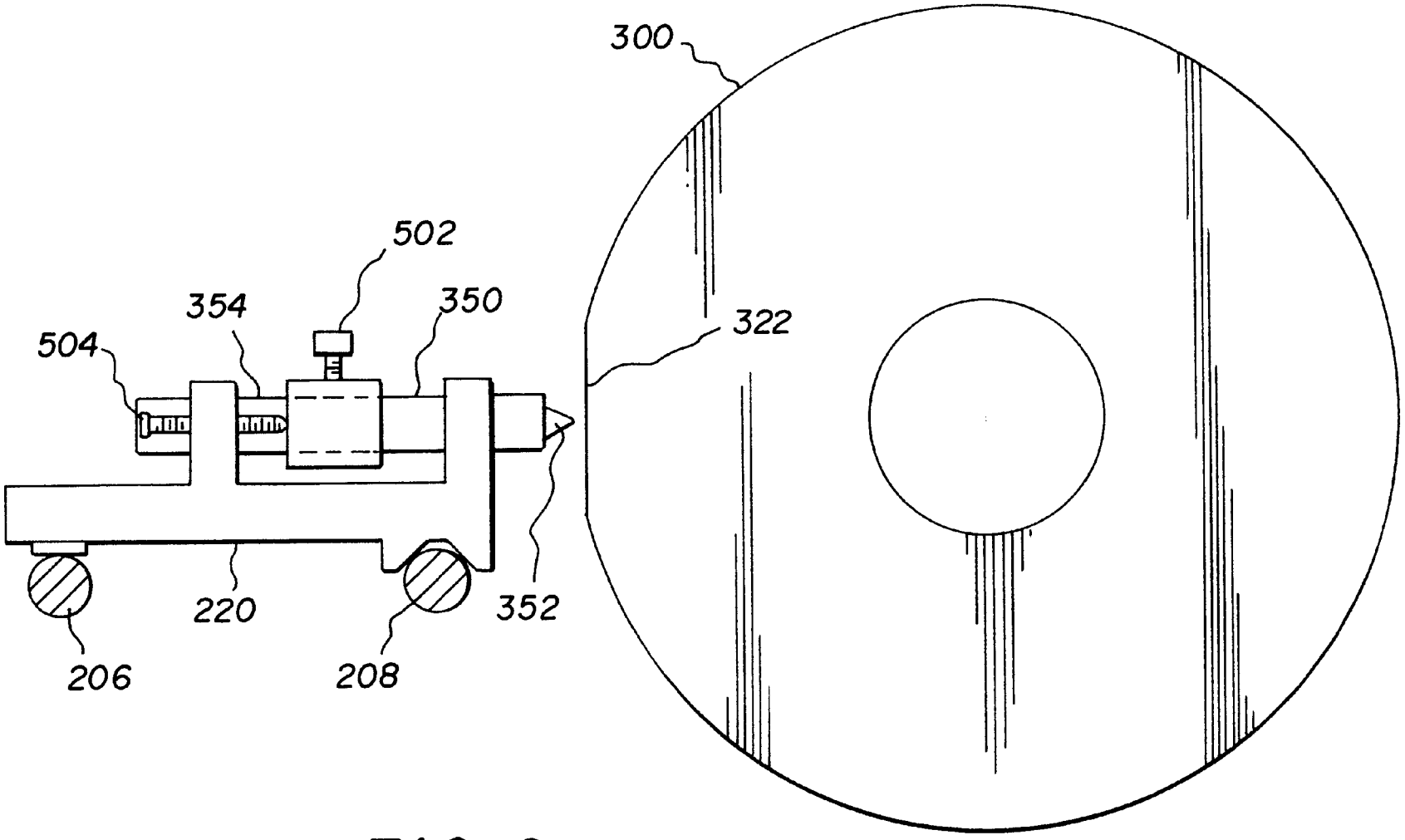
FIG. 9 is an end view of the finishing assembly and the vacuum imaging drum such that the axially extending flat is positioned in front of the finishing assembly.
Figure 10:
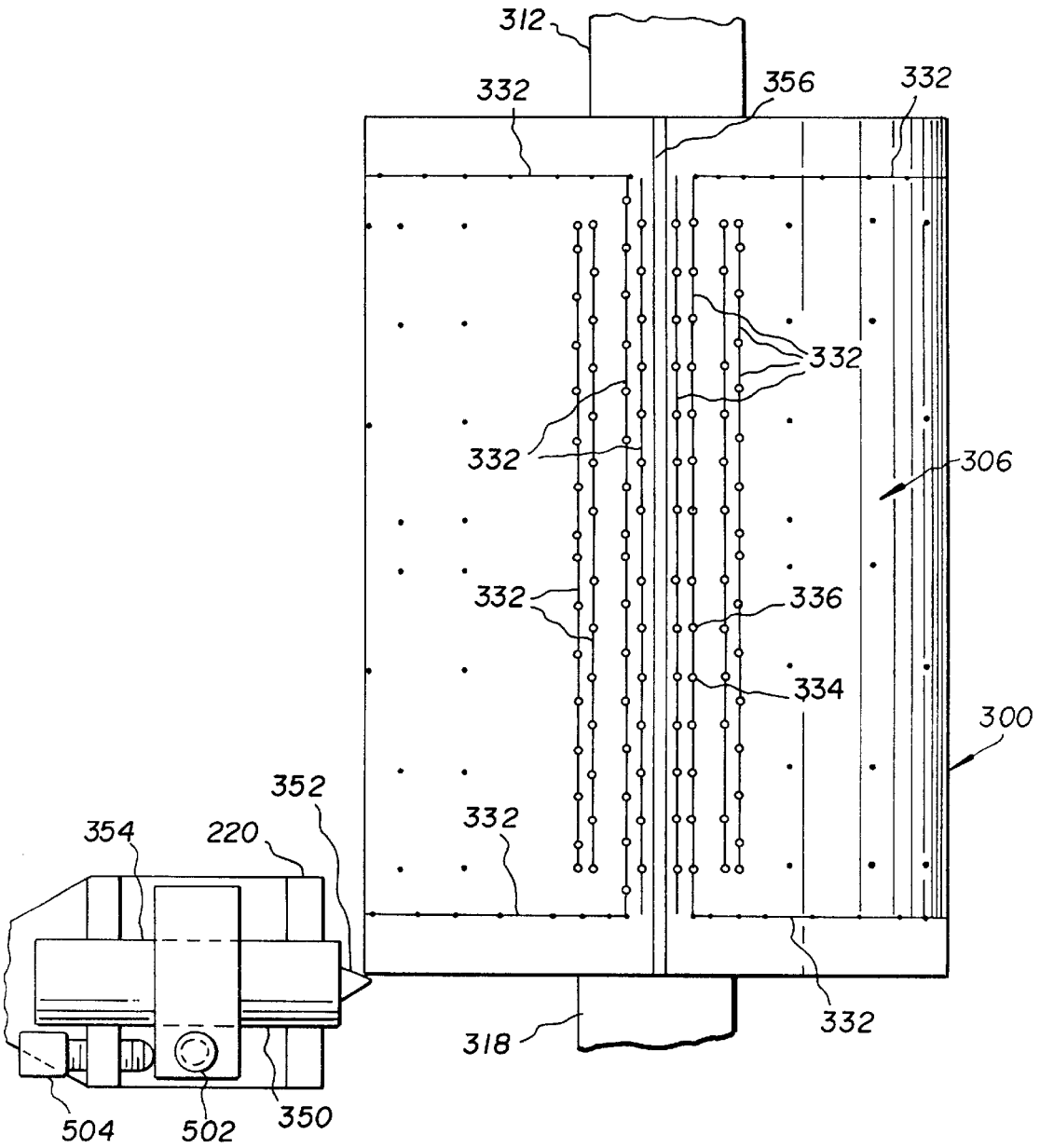
FIG. 10 is a plane view of the vacuum imaging drum with donor support rings removed and the finishing assembly positioned at the end of the vacuum imaging drum.
Figure 11:
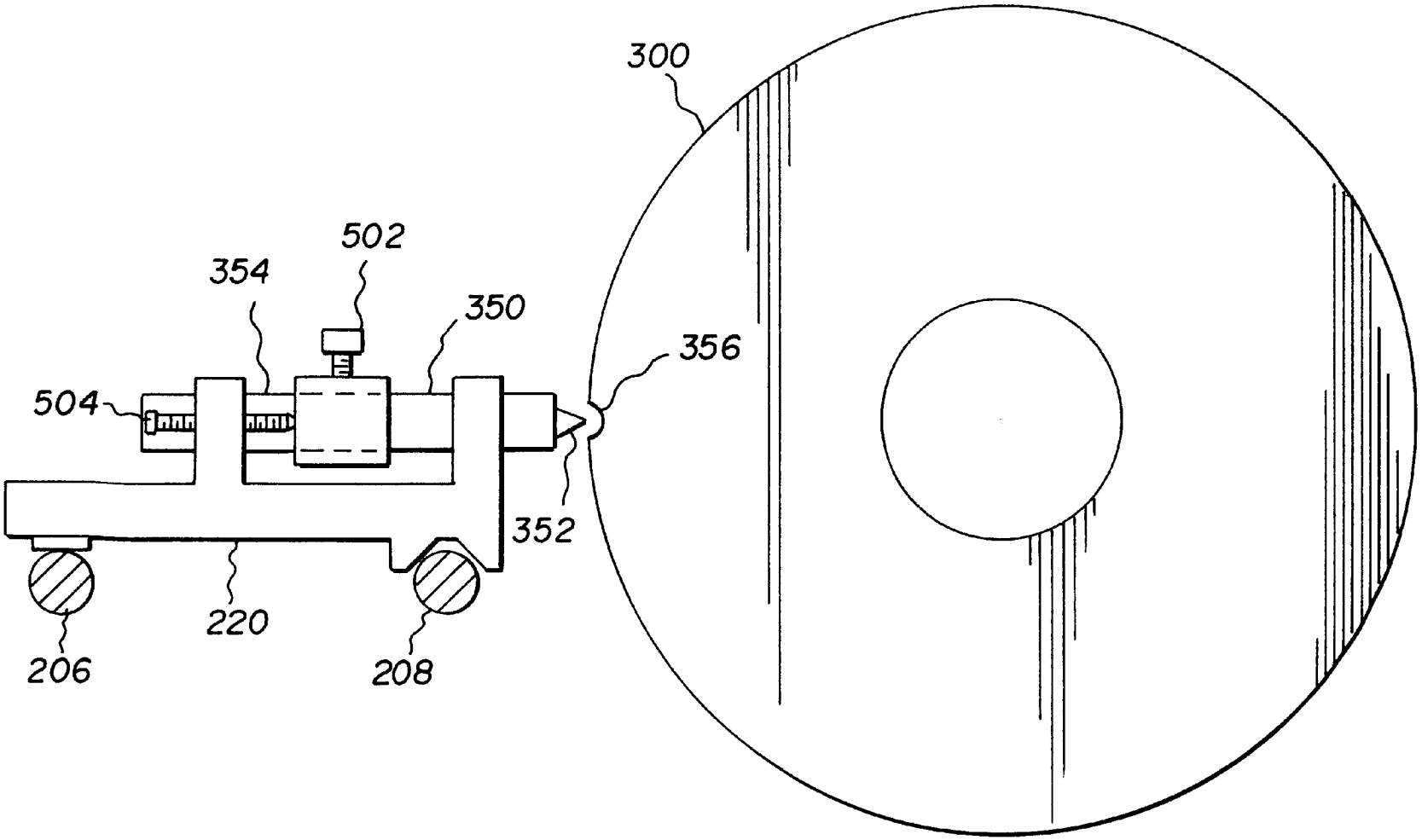
FIG. 11 is an end view of the finishing assembly and the vacuum imaging drum with the axial return relief positioned in front of the finishing assembly.

To minimize variations in the distance between the printhead and the surface of the vacuum imaging drum 300 and the linear translation system 240. A finishing assembly 350, as shown in FIG. 7), is mounted on the translation stage member 220. The finishing assembly diameter is the same as that of the printhead 500 such that the finishing tool 352, for example, a single point diamond, is mounted in the finishing barrel 354 is on the same optical axis as the printhead 500. The lath bed scanning subsystem 200 positions the translation stage member 220 such that the finishing tool 352 mounted in the finishing assembly 350 is positioned in the first relief 346 on the vacuum imaging drum 300. Utilizing the focus adjustment 504 for the printhead 500 the finishing assembly is moved inward to a position with the finishing tool 352 just off the image surface of the circumferential recess 326 of the vacuum imaging drum 300. The lath bed scanning subsystem 200 rotates the vacuum imaging drum 300, while moving the translation stage member 220 along the axis of the vacuum imaging drum 300 at the appropriate speeds until the finishing tool 352 is lined up with the second relief 348, as shown in FIG. 8. The vacuum imaging drum 300 is then brought to a stop with the axially extending flat 322 of the vacuum imaging drum 300 positioned in front of the finishing tool 352, shown in FIG. 9, such that the linear translation system 240 can move the finishing tool 352 back to the first relief 346 without having to back the finishing tool 352 away from the vacuum imaging drum 300. With the finishing tool 352 returned to the first relief 346 the finishing tool 352 is moved inward toward the vacuum imaging drum 300 the appropriate distance typically one micron. The process is then repeated until the variability of the vacuum imaging drum 300 and linear translation system 240 has been minimized in the image surface of the circumferential recess 326 of the vacuum imaging drum 300. As shown in FIGS. 10 and 11, the vacuum imaging drum 300 is not required to have donor support rings 324 or an axially extending flat 322 as long as an axial return relief 356 is provided such that the finishing tool 352 does not have to be backed off until the process is completed. With the variability removed the finishing assembly 350 is removed and the printhead 500 is installed. The above mentioned process can be done in a master lath bed scanning subsystem (not shown) or in a production lath bed scanning subsystem 200.

The invention has been described with reference to the preferred embodiment thereof. However, it will be appreciated that variations and modifications can be effected within the spirit and scope of the invention as described herein and as defined in the appended claims by a person of ordinary skill in the art without departing from the scope of the invention. For example, the invention is applicable to any drum. Although not described in detail it would be obvious to some one skilled in the art that this invention could be used on both external or internal drums. Also, the axially extending flat may be a recessed area, concave or other shape, extending axially along the surface of the vacuum imaging drum. Also, the dye donor may have dye, pigments, or other material which is transferred to the thermal print media. Thermal print media includes paper, films, plates, and other material capable of accepting or producing an image.

PARTS LIST

10. Image processing apparatus
12. Image processor housing
14. Image processor door
16. Donor ejection chute
18. Donor waste bin
20. Media stop
30. Roll media
32. Thermal print media
34. Dye donor roll material
36. Dye donor sheet material
50. Sheet material trays
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
180. Color binding assembly
182. Media entrance door
184. Media exit door
198. Master Lathe bed scanning engine
200. Lathe bed scanning subsystem
202. Lathe bed scanning frame
204. Entrance passageway
206. Rear translation bearing rod
208. Front translation bearing rod
220. Translation stage member

222. Vacuum fitting
224. Vacuum blower
240. Linear translation system
250. Lead screw
252. Threaded shaft
254. Lead screw drive nut
256. Drive coupling
258. Linear drive motor
60. Axial load magnets
260*a*. Axial load magnet
260*b* Axial load magnet
262. Circular-shaped boss
264. Ball bearing
266. Circular-shaped insert
268. End cap
270. Hollowed-out center portion
272. Radial bearing
300. Vacuum imaging drum
301. Axis of rotation
302. Vacuum drum housing
304. Hollowed out interior portion
306. Vacuum hole
308. Vacuum end plate
310. Drive end plate
312. Drive spindle
314. Support bearing
316. DC drive motor armature
318. Vacuum spindle
320. Central vacuum opening
322. Axially extending flat
324. Donor support ring
326. Circumferential recess
332. Vacuum grooves
334. Counter sunk vacuum holes
336. Blind Counter sunk vacuum holes
340. Drive nut
342. DC motor stator
344. Drum encoder
346. First radial recess
348. Second radial recess
350. Finishing assembly
352. Finishing tool
354. Finishing barrel
356. Axial return relief
400. Laser assembly
402. Lasers diode
404. Fiber optic cables
406. Distribution block
454. Optical centerline
500. Printhead
502. Head angle adjustment
504. Focus adjustment

What is claimed is:

1. A method of precision finishing a vacuum imaging drum comprising the steps of:

a) positioning a finishing tool at an axial starting point;

b) rotating said vacuum imaging drum at a predetermined speed;

c) moving said finishing tool to a radial first position;

d) translating said finishing tool in a first direction, approximately parallel to an axis of rotation of said vacuum imaging drum, until at least a portion of a surface of said vacuum imaging drum is transversed;

e) stopping rotation of said vacuum imaging drum, wherein an axial recess on an external surface of said vacuum imaging drum is located directly adjacent said finishing tool;

f) returning said finishing tool to said axial starting point without radial movement of said finishing tool;

g) moving said finishing tool to a second radial position, wherein said second radial position is closer to said axis of rotation than said first radial position; and h) repeating steps b–g until a predetermined amount of material has been removed from said surface.

2. A method of precision finishing a vacuum imaging drum as in claim 1 wherein said second radial position is a predetermined incremental distance.

3. A method of precision finishing a vacuum imaging drum as in claim 2 wherein said predetermined incremental distance is used for each repetition of steps b–g.

4. A method of precision finishing a vacuum imaging drum as in claim 1 wherein said axial recess is a flat area on said surface.

5. A method of precision finishing a vacuum imaging drum as in claim 1 wherein said axial recess is a concave area on said surface.

6. A method of precision finishing a vacuum imaging drum as in claim 1 wherein said starting point is located adjacent a first radial recess.

7. A method of precision finishing a vacuum imaging drum as in claim 6 wherein rotation of said vacuum imaging drum is stopped adjacent a second radial recess.

8. A method of precision finishing a vacuum imaging drum as in claim 1 wherein said vacuum imaging drum is a component of an image process apparatus.

9. A method of precision finishing a vacuum imaging drum as in claim 8 wherein said imaging processing apparatus is a printer.

10. A method of precision finishing a vacuum imaging drum as in claim 1 wherein said finishing tool is attached to a translation stage of a printer.

11. A method of precision finishing a vacuum imaging drum comprising the steps of:

a) rotating said drum at a predetermined speed;

b) moving a finishing tool from an axial starting point into a radial first position;

c) translating said finishing tool in a first direction until at least a portion of a surface of said vacuum imaging drum is transversed;

d) stopping the rotation of said vacuum imaging drum, wherein an axial recess on an external surface of said vacuum imaging drum is located directly adjacent said finishing tool;

e) returning said finishing tool to said axial starting point without radial movement of said finishing tool;

f) moving said finishing tool to a second radial position, wherein said second radial position is closer to said surface than said first radial position; and g) repeating steps a–f until a predetermined amount of material has been removed from said surface.

* * * * *